US006615814B1

(12) United States Patent
Rice et al.

(10) Patent No.: US 6,615,814 B1
(45) Date of Patent: Sep. 9, 2003

(54) PAINTBALL GUNS

(75) Inventors: John Ronald Rice, Stoke-on-Trent (GB); Nicholas John Marks, Stoke-on-Trent (GB)

(73) Assignee: NPF Limited, Birmingham (GB)

( * ) Notice: Subject to any disclaimer, the term of this patent is extended or adjusted under 35 U.S.C. 154(b) by 0 days.

(21) Appl. No.: 09/607,838

(22) Filed: Jun. 30, 2000

Related U.S. Application Data

(63) Continuation-in-part of application No. 09/418,224, filed on Oct. 14, 1999, and a continuation-in-part of application No. 09/418,225, filed on Oct. 14, 1999, which is a continuation-in-part of application No. 09/272,652, filed on Mar. 18, 1999, now abandoned.

(30) Foreign Application Priority Data

Jul. 16, 1999 (GB) ..... 9916688
Jul. 19, 1999 (GB) ..... 9916814
Apr. 18, 2000 (GB) ..... 0009513

(51) Int. Cl.[7] ..... F41B 11/00
(52) U.S. Cl. ..... 124/71; 124/77
(58) Field of Search ..... 124/34, 70–77; 89/28.05, 28.1; 42/1, 2

(56) References Cited

U.S. PATENT DOCUMENTS 1,512,022 A * 10/1924 Hendrickson ..... 137/552
2,359,032 A * 9/1944 Gott ..... 348/211
2,747,607 A * 5/1956 Matasovic ..... 137/505.42
3,139,902 A * 7/1964 Thomas ..... 137/557
3,250,292 A * 5/1966 Mollick ..... 137/557
3,711,638 A * 1/1973 Davies ..... 244/1 R
3,798,796 A * 3/1974 Stauff et al. ..... 348/143
3,842,526 A * 10/1974 Dixon ..... 42/1.01
4,019,180 A * 4/1977 Graves ..... 342/53
4,189,143 A * 2/1980 Van Auken et al. ..... 116/222

(List continued on next page.)

FOREIGN PATENT DOCUMENTS

GB 2066932 * 7/1981 ..... 137/505.39

OTHER PUBLICATIONS

"What an Angel" (article re Angel V6 Gear Special), PGI product catalog, Mar. 1997, pp. 74–75.

"What an Angel" (article re Angel V6 Gear Special), PGI product catalog, pp. 74–75.

WDP Ltd., "Angel ™ Operators Manual", Issue No.2 Angel Users Guide, brochure.

*Primary Examiner*—Charles T. Jordan
*Assistant Examiner*—Stephen A. Holzen
(74) *Attorney, Agent, or Firm*—Foley & Lardner

(57) ABSTRACT

A paintball gun is disclosed which includes a data link for transferring data to and/of from a remote terminal. The link may be a contact or contactless one. A removable data carrier may be used.

54 Claims, 2 Drawing Sheets

U.S. PATENT DOCUMENTS 4,205,589 A * 6/1980 Engler et al. ..... 42/84
4,220,992 A * 9/1980 Blood et al. ..... 377/26
4,256,013 A * 3/1981 Quitadama ..... 42/84
4,541,191 A * 9/1985 Morris et al. ..... 42/1.01
4,694,850 A * 9/1987 Fumino ..... 137/318
4,718,187 A * 1/1988 Blake ..... 42/84
4,770,153 A * 9/1988 Edelman ..... 124/72
4,802,504 A * 2/1989 Politi ..... 137/454.5
5,044,107 A * 9/1991 Holford ..... 42/106
5,084,695 A * 1/1992 Freeman ..... 116/222
5,140,144 A * 8/1992 Shepard et al. ..... 235/472.01
5,142,805 A * 9/1992 Horne et al. ..... 42/1.02
5,181,009 A * 1/1993 Perona ..... 273/DIG. 26
5,280,778 A 1/1994 Kotsiopoulos ..... 124/73
5,303,495 A * 4/1994 Harthcock ..... 162/178
5,448,847 A * 9/1995 Teetzel ..... 42/70.11
5,559,490 A * 9/1996 McDonald et al. ..... 273/317
5,564,211 A * 10/1996 Mossberg et al. ..... 42/70.01
5,566,486 A * 10/1996 Brinkley ..... 42/1.02
5,566,934 A * 10/1996 Black et al. ..... 473/431
5,570,528 A * 11/1996 Teetzel ..... 42/70.11
5,614,679 A * 3/1997 Johnson ..... 73/756
5,642,581 A * 7/1997 Herold et al. ..... 42/1.02
5,668,803 A * 9/1997 Tymes et al. ..... 370/312
5,675,925 A * 10/1997 Wurger ..... 42/70.06
5,704,153 A * 1/1998 Kaminski et al. ..... 42/70.11
5,727,538 A * 3/1998 Ellis ..... 124/32
5,736,720 A * 4/1998 Bell et al. ..... 235/1 B
5,782,028 A * 7/1998 Simon et al. ..... 42/70.11
5,826,360 A * 10/1998 Herold et al. ..... 42/1.02
5,831,261 A * 11/1998 Plesko ..... 250/221
5,834,676 A * 11/1998 Elliott ..... 42/113
5,881,707 A * 3/1999 Gardner, Jr. ..... 124/77
5,896,691 A * 4/1999 Kaminski et al. ..... 42/117
5,947,738 A * 9/1999 Muehle et al. ..... 124/57
5,949,015 A * 9/1999 Smith et al. ..... 89/40.03
5,953,844 A * 9/1999 Harling et al. ..... 42/70.06
5,954,507 A * 9/1999 Rod et al. ..... 42/84
5,967,133 A * 10/1999 Gardner, Jr. ..... 124/77
6,003,504 A * 12/1999 Rice et al. ..... 124/73
6,009,900 A * 1/2000 Elgert et al. ..... 137/557
6,035,843 A * 3/2000 Smith et al. ..... 124/77
6,039,574 A * 3/2000 Standiford et al. ..... 273/237
6,062,208 A * 5/2000 Seefeldt et al. ..... 124/71
6,138,656 A * 10/2000 Rice et al. ..... 124/73
6,142,137 A * 11/2000 MacLaughlin ..... 124/32
6,237,271 B1 * 5/2001 Kaminski ..... 42/70.01
6,305,367 B1 * 10/2001 Kotsiopoulos et al. ..... 124/49
6,311,682 B1 * 11/2001 Rice et al. ..... 124/71
6,321,478 B1 * 11/2001 Klebes ..... 42/70.11

* cited by examiner

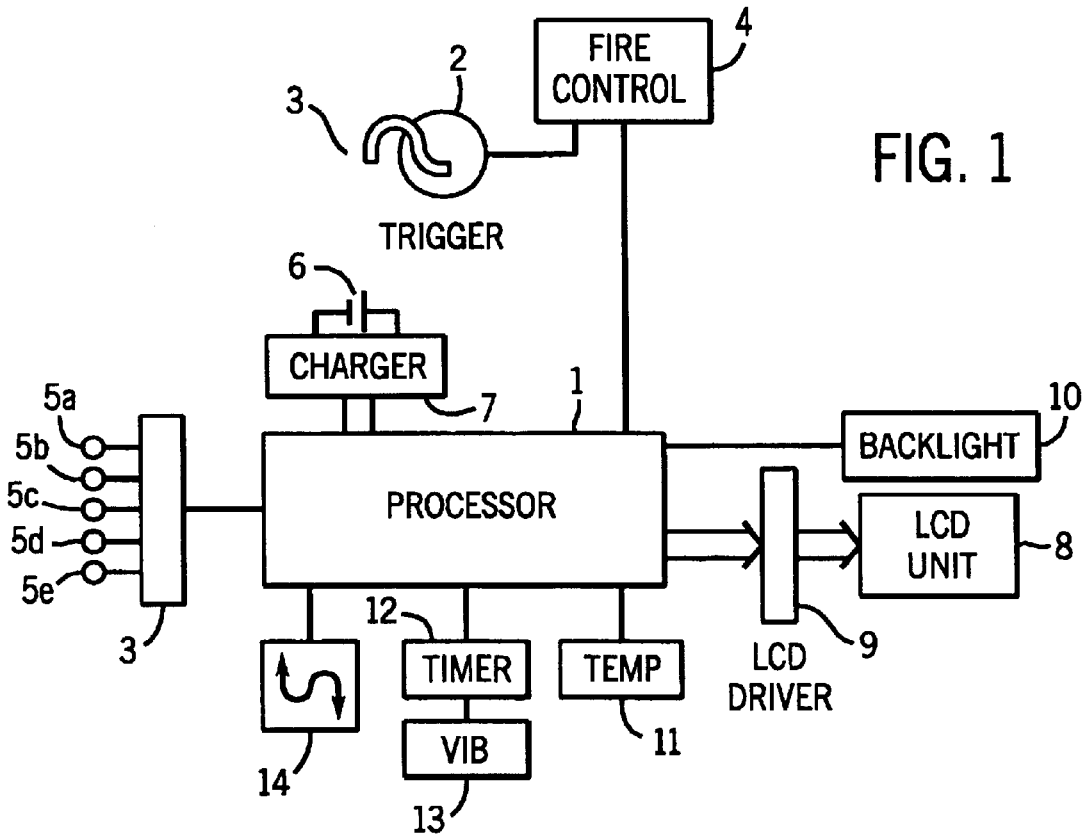
FIG. 1
FIG. 2
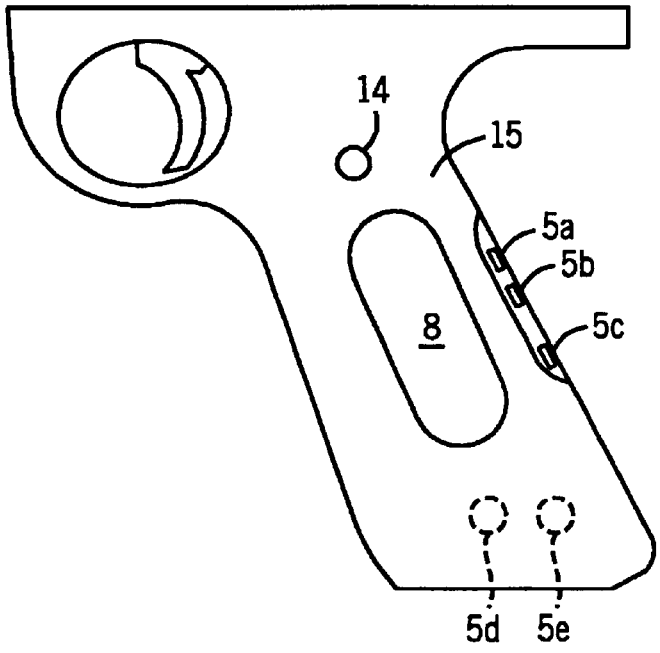
FIG. 5
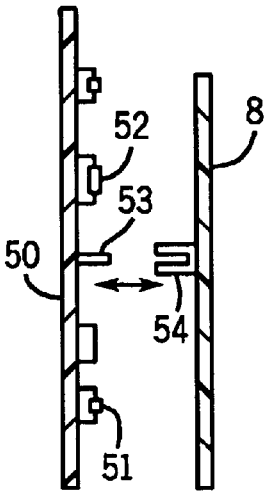

PAINTBALL GUNS

This application is a continuation-in-part of application Ser. No. 09/418,224, filed Oct. 14, 1999, and a continuation-in-part of application Ser. No. 09/418,225, filed Oct. 14, 1999, which are each a continuation-in-part of application Ser. No. 09/272,652, filed Mar. 18, 1999, now abandoned.

This invention relates to paintball guns.

The game of paintball involves participants carrying guns which fire pellets of 'paint' or dye which are fired from the gun and burst upon impact to leave a mark at the point of impact.

Most paintball guns use a pneumatic system for firing the paintballs using compressed air or other gas. More recently, such pneumatically operated guns have begun to be electronically controlled for greater effectiveness.

According to the present invention there is provided a paintball gun including a data link for transferring data to and/or from a remote terminal.

According to the present invention there is further provided electronic apparatus, comprising a paintball gun, a terminal and means for transferring data and/or communicating between the gun and terminal.

A display panel may be mounted on the gun or may be alternatively (or additionally) be situated remote from the gun. For example, the display panel may be a display on a remote terminal such as a computer terminal, a personal digital assistant (PDA), a telephone or many other devices, such as components attached to the gun. Data may be transferred to the panel by a direct (wired link) for example a serial link, USB link or other link, or by a contactless method, such as by infrared communication, radio links (digital or analog), microwave links, or even by telephone/cable internet, etc.

Alternatively, the remote terminal may not have a display. It may simply store and/or process data.

Alternatively data my be transferred by means of a removable data carrier, such as a smart card, SIM, flash card, a disk or tape or other means between the gun and an external terminal.

Embodiments of the invention will now be described, by way of example only, with reference to the accompanying drawings in which:

FIG. 1 shows schematically an electronic apparatus for use in a paintball gun;

FIG. 2 shows the handle of a gun;

FIG. 5 shows a side view of a display and a circuit board.

Figure 3:
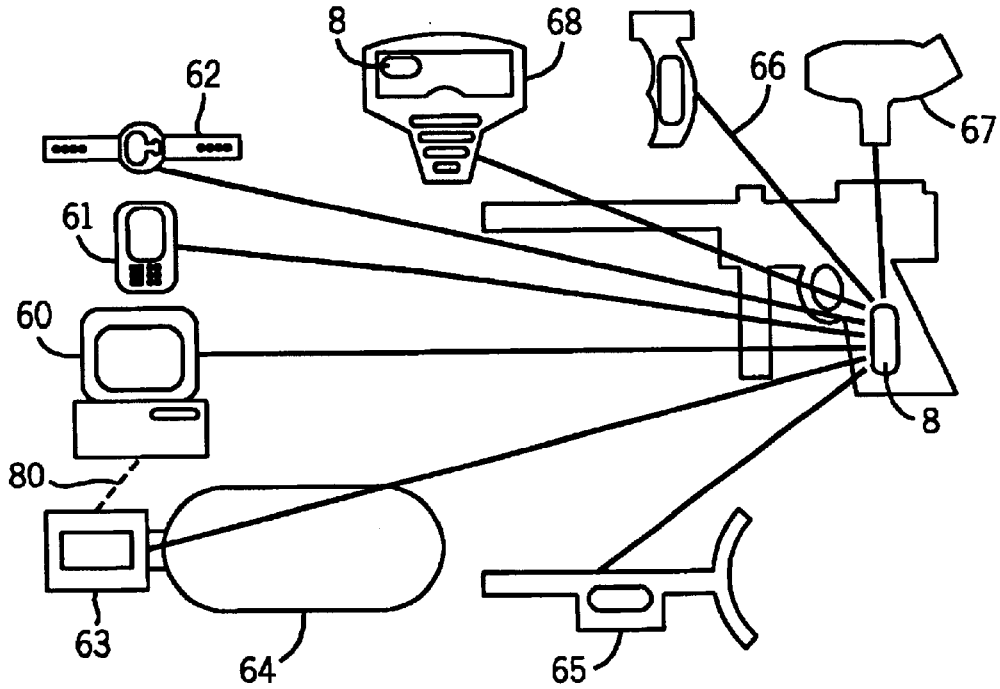
FIG. 3 shows schematically external terminals linked to a paint gun.

A paintball gun embodying the present invention uses a compressed gas circuit supplied with gas from a gas cylinder to eject projectiles in the form of spheres containing paint which break upon impact. The gun is electronically controlled, typically by a microswitch operated upon by a trigger squeezed by a user's finger and the electronics control the firing mechanism and in particular ensure correct timing. The electronics also enable various different modes of firing, for example a semi-automatic mode in which each trigger actuation causes a projectile to be fired, typically up to 20 times a second, or a fully automatic mode in which a single trigger actuation causes a burst of a selectable number of shots. Other parameters such as dwell time, firing rate, number of bursts per second, and so on are also selectable under the operation of the control electronics. A paintball gun of this type is commercially available as the Angel™ gun manufactured by NPF Limited and reference is made to U.S. Patent application Ser. No. 09/137,641.

FIG. 1 shows a control and display apparatus for use in a gun according to the present invention. The apparatus comprises a central processor 1 which typically includes a microprocessor. As described, operation of the gun is initiated by a user depressing a trigger 2 which acts upon a microswitch in known manner. This sends an appropriate signal to fire control/monitoring circuitry 4, which may be at least partially incorporated in the control unit 1 and which can be used to control the rate of fire, dwell time, etc, and also to fire the gun when the trigger has been operated, using the mode designated by the user. These modes may be, for example, manual, semi-automatic or automatic modes or other modes as required or as allowed by the rules of the particular event or tournament he is playing in. These operate in known manner.

A plurality of input buttons 5*a* to 5*e* are arranged to provide user input to the processor 1 via a user interface 3 and these have several different functions as will be outlined below.

The gun is powered by a battery 6 which is preferably a rechargeable type and which can charge through a battery charger 7 which has a mains input. The battery charger may have means for indicating the approximate charge on the battery.

An integral alphanumeric display unit in the form of an LCD unit 8, driven by an LCD driver circuit 9 is preferably connected to the processor and this displays various types of data and information. Preferably, a back-light 10 is also provided to enable better viewing of the LCD unit but which back-light may be turned off when required. The alphanumeric display need not necessarily be an LCD display. Alternatively, the gun may not have an integral display.

Various other pieces of apparatus, sensors, etc, may be added to the control unit and non-limiting examples of these are shown in FIG. 1. There is shown a temperature sensor 11, a timer 12 and a vibrator 13. The timer 12 can be used for various purposes such as for timing a paintball game and for an alarm function and the vibrator 13 may be used as the alarm indicator for the timer 12. In addition, a data link, such as an infrared link 14 is provided which enables programming of the control unit, or bi-directional data exchange, to take place from a remote PC or other device fitted with a similar infrared unit. Infrared communication devices are well known. A serial link, eg RS232C, radio link or other communications link may also be provided. So called 'blue tooth' technology may be used for radio communication FIG. 2 shows the grip frame part of a paintball gun. The user holds the grip in the normal manner and squeezes the trigger 2 to fire the gun. As shown, the gun is radically different from previous paintball gun designs in that an LCD display 8 is integral with and incorporated into the gun, in this case on the cheek of the grip frame 15. It could, however, be mounted in any other position/disposition on the gun itself. The control buttons are also distributed on the grip frame. Three of the buttons 5*a*, 5*b* and 5*c* are mounted in a recessed portion where they are always accessible. The remaining buttons in this embodiment are mounted under a cheek plate (not shown) which is screwed or otherwise attached over the cheek, possibly using anti-tamper means, or tamper-indicating means such as seals, and thus are only accessible when the plate is removed. This is because these buttons are used to alter various functions of the gun which affect its performance, rate of fire, etc. In many events, the rate of fire or other gun parameters must be set before the game begins and cannot be altered once the match is underway. By being mounted in an inaccessible position, these buttons achieve this objective.

As shown in FIG. 5, the display panel may be removable. In one embodiment, it is mounted on a substrate 50 formed by a printed circuit board on which electronic components 51,52 are mounted. Electrical connection between the board 50 and display 8 is made via a plurality of pins (of which one is shown, 53) and co-operating sockets 54. By simply pulling these apart, the panel can be removed. In an alternative embodiment, a so-called Ziff (zero insertion force) socket can be used. This type of socket is commonly used for microprocessors. Other methods of removably connecting the display may be used.

Various values and words are selectably displayed by a six character alphanumeric display 24 and a plurality of fixed words/characters which are illuminated as required. A battery indicator 20 is displayed at all times and goes from blank to full (all four segments displayed). When down to about 25% power level the last segment only is displayed, and this flashes indicating low power status.

A mode indicator 21 displays the mode of firing and may show single characters or numerals such as A, B, C, 1, 2, 3 etc. Modes are displayed at all times. The mode of firing can only be changed by one of the normally inaccessible tactile switches 5*d* or 5*e*. The modes available may be, for example, SEMI: (1 shot; 1 trigger pull), BURSTS: (a 3, 4, 5, 6, 7 or 8 shot burst per trigger pull), ZIPS (3, 4, 5, 6, 7, 8 shot bursts at a rate of 8.75 shots/sec max). The MROF (Maximum Rate of Fire) function will display 8 when in the ZIP modes.

The vibrator may work in a timer mode for indicating, for example, 5 min intervals by actuating the vibrator for 3 secs. Note: if the 'V' mode is selected the 'V' is displayed on the LCD. Switching the vibratory alarm ON or OFF is selected from a sub-menu function.

Temperature may be displayed in ° F. or ° C. by the main alphanumeric display 24. A temperature icon is only displayed when the menu calls for it. Temp mode can be selected from the menu; Changing from Centigrade to Fahrenheit is selected from the sub-menu.

A trip meter is a shot counter that can be re-zeroed by the consumer. Trip can be selected from the menu. Resetting to zero is selected from the sub-menu.

A ROF (Rate of Fire) function may measure a string of shots over a selected (eg 1 second) period. The first shot starts the counter for 1 second, any shots that occur in that period are registered on the display. Then the display will not accept any input for a 3-second period. During this period the display will also flash before an additional cycle may start. The ROF mode can be selected from the menu. The data is constantly updated and so no sub-menu is required. ROF can also record the shortest time interval between any two shots, which can remain in memory until superseded or deleted. This allows for a peak value of ROF to be viewed later, without fear of interrupting a game.

The display can accordingly display not only a desired rate of fire, but also the rate of fire actually achieved by the user, which can fall well short of the desired rate of fire, or could even exceed it for a very skilled marksman. Furthermore, competition rules may set an upper limit on the rate of fire, and this upper limit may be programmed in and displayed on the LCD display (MROF). More details are set out further below.

To power off the gun a tactile switch on the grip must be held for 1.5 seconds which shows the whole display for 2 seconds. Then the display shows the word "SAFE" and the back light switches OFF. The gun cannot fire in the safe mode but the battery meter is still displayed. An automatic power off function may be provided which powers off the gun if no shots are fired for a predetermined period, e.g. 60 minutes.

A unique ID number may be programmable into the gun by the manufacturers or suppliers. This number may affect, e.g. restrict, the modes it is possible for the gun to be fired in and can render the gun less likely to be stolen.

Numerous fault codes can be displayed, for example Fault 1, F1=Over temp=38° C., F2=Under temp=0° C., and so on. The fault can be selected from the menu. Should more than one fault be present the display will alternate at 2-sec cycles. The faults will only clear from the display when the fault condition is removed.

Dwell time may be displayed, e.g. in millisecs=e.g. 0:20=20 ms. Dwell is changed via a tactile button and scrolls from 12 ms to 25 ms.

MROF displays the rate of fire as shots per sec, e.g. 12=12 shots/sec. MROF may be selected from the menu but can only be changed via one of the normally inaccessible tactile buttons on the board. In one embodiment the range is 5 to 20 shots per second.

Note: If a mode of fire has a preset rate this will be displayed under the MODE function and cannot be adjusted whilst in that mode.

A cycles counter is a grand total shot counter that cannot be reset by the consumer, only by the suppliers of the gun or other authorised person.

A TRIP counter is provided, which is a shot counter that can be zeroed by the user or consumer.

A timer is a countdown timer which can, for example, count down from 60 min. At the end of the count the vibrator alarm may be activated for 10 seconds. The timer can be set in 5-min increments, i.e. OFF, 5, 10, 15 etc. A sub-menu allows changes. The settings must remain in the memory even after power has been removed.

The display may also indicate test modes and a BACK-LIGHT ON symbol 22 is included. Additional functions displayable include, inter alia, velocity, average velocity, gas pressure and gas usage, for example.

In one embodiment DWELL, MROF, MODE and TIMER functions are stored in non-volatile memory since these settings must be retained even when power is removed.

Many other parameters of the gun's operation, or of a game being played (score, timer functions, etc) may be displayed.

The gun may alternatively not have an integral display at all. If it does not have an integral display, or even if it does have a display, the data-link 14 may be used to communicate with an external terminal, preferably for displaying information at the remote terminal. The term 'terminal' is to be construed widely, and non-limiting examples of terminals are shown schematically in FIG. 3. Others will be apparent.

The terminal could be a PC or other computer or computer terminal 60. Other items shown by way of example include hand-held devices 61, such as palm-top computers, PDAs, mobile telephones and so on. A watch 62 or other wearable device could be a terminal. A display mounted on a gas regulator (shown attached to a gas canister 64) could be used. A display may be mounted on a stock 65 or on a fore grip 66 or paint-ball hopper 67. A display may be mounted 'head-up' style in a face mask, goggles or other safety equipment which would normally be worn by a user of a paintball gun.

The terminal may indeed be another gun, so that users can communicate and transfer data between each other.

The external terminal may be used to simply download information to regarding the progress and results of a game and/or the gun's operation or performance, or to upload information, programming data or software upgrades to a gun, in which case it will generally be connected after or before a game. Alternatively, or in addition, it can be used to display parameters relating to the gun's operation or an ongoing game, preferably in real-time. The connection with an external terminal (display) may be wired connections, such as RS 232 connections, USB connections, IEEE 1394 (firewire), or other types. It could alternatively be by a wireless method such as infrared or radio. Many radio protocols are available or will be available and one such protocol is known as 'blue tooth'. Connections may also be made over LANS, WANS or by any telecommunication system or over the internet for example. By fitting a modem or an ISDN adaptor or other suitable interface, the gun may be connected to the internet or telecommunications system. The nature and operation of such systems is known to those skilled in the art, and will not be discussed in detail.

Figure 4:
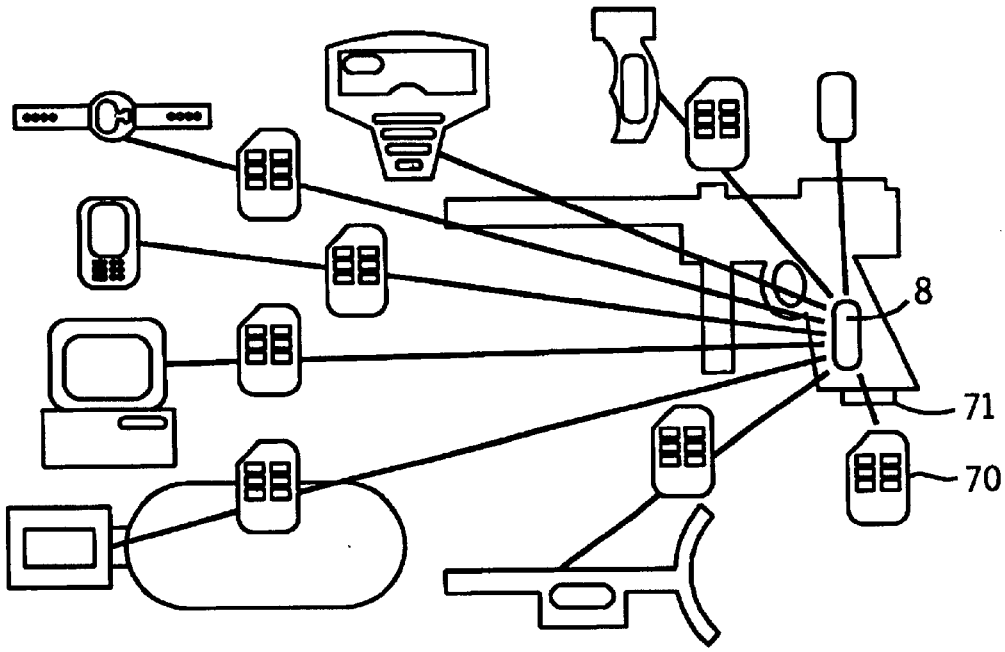
FIG. 4 shows schematically external terminals receiving or transmitting data from or to a paintball gun by means of a data carrier.

Instead of directly transferring data, the data may be transferred on a data carrier. FIG. 4 shows a gun which is adapted to receive a data carrier 70. This may be an electronic token such as a smart card, or a SIM card, a memory card (eg flash card, PROM, EPROM, etc or a memory stick). It may alternatively be a disk or tape type device such as a floppy disk. CD ROM, DVD, etc. The gun includes a suitable location 71 for receiving a data carrier and including means for transferring data to and/or from the carrier. These means will be apparent to the skilled reader. Card readers, for example, or disk drive/control mechanisms are widely available.

The gun may be one with or without a display 8. The carrier may be removed from the gun when desired and used to input data into a cooperating means associated with a terminal. For example, if the carrier is a smart card, then a smart card reader can be integrated or connected to any terminal (PC, PDA, watch, gas regulator, gun components, etc).

With a data carrier, the manufacturer or supplier of a gun can easily provide product (software) upgrades or view or supply various types of information.

Among the features which may be monitored and/or displayed locally and/or remotely are:

Temperature (working and ambient)

Dwell (value opening time)

ROF (rate of fire achieved)

MROF (maximum rate of fire limit)

Dwell (time of value opening)

Modes (style of shooting, semi auto etc)

Pressures (working pressures)

Battery Condition

Cycles (total shots fired)

Trip (resettable shot counter)

Backlighting (for improved visibility)

Vibrator (timer alarm)

Optical (timer alarm)

Audio able (timer alarm)

Fault codes (self diagnostics)

Pin number (programmable electronic lock)

ID number (electronic ID number)

Factory resetting (sets to defaults)

Game timer with programmable alarms intervals and fixed intervals

Ability to change the state of the timer alarms.

Note that FIGS. 3 and 4 show a gas regulator adapted for communication (data transfer) with a paintball gun. The present invention also extends to a gas regulator having means for transferring data to and/or from any external terminal (as indicated schematically by dashed line 80).

What is claimed is:

1. A paintball gun in communication with a remote terminal, the paintball gun comprising:

an input;

a pneumatic system coupled to the input for firing one or more paintballs;

a processing unit coupled to the input, the processing unit controlling operation of the pneumatic system in response to information received from the input, the processing unit generating pneumatic system operation data gathered during operation of the gun, the pneumatic system operation data including pneumatic circuit firing mechanism operation data; and a data communication link coupled to the processing unit, the data communication link electronically transmitting the pneumatic system operation data to the remote terminal.

2. A paintball gun as claimed in claim 1, wherein the data communication link provides a wired connection to the remote.

3. A paintball gun as claimed in claim 1, wherein the data communication link provides a wired connection to the remote terminal.

4. A paintball gun as claimed in claim 3, wherein the connection uses radio waves.

5. A paintball gun as claimed in claim 3, wherein the connection uses infrared radiation.

6. A paintball gun as claimed in claim 1, wherein the gun has an integral display.

7. A paintball gun as claimed in claim 1, further having a display which is removably connected to the gun.

8. The paintball gun of claim 1, wherein the pneumatic system operation data further includes at least one of pneumatic circuit temperature, pneumatic circuit dwell time, rate of fire, maximum rate of fire, firing mode, pressure, battery condition, shots fired and identification number.

9. The paintball gun of claim 1, wherein the pneumatic system operation data is transmitted in real-time.

10. The paintball gun of claim 1, wherein the pneumatic system operation data is transmitted to the remote terminal for display of the pneumatic system operation data.

11. The paintball gun of claim 1, wherein the pneumatic system operation data is transmitted to the remote terminal for storing the pneumatic system operation data.

12. The paintball gun of claim 1, wherein the pneumatic system operation data is transmitted to the remote terminal for processing the pneumatic system operation data.

13. The paintball gun of claim 1, wherein the remote terminal is selected from the group consisting of: a computer; a hand-held device; a gun component; a gas regulator; a watch; a mobile telephone; goggles; and a component mounted on a gun.

14. A paintball gun comprising:

an input;

a pneumatic system coupled to the input for firing one or more paintballs;

a processing unit coupled to the input, the processing unit controlling operation of the pneumatic system in response to information received from the input, the processing using generating pneumatic system operation data gathered during operation of the gun, the pneumatic system operation data including pneumatic circuit timing data; and a data communication link coupled to the processing unit, the data communication link electronically transmitting the pneumatic system operation data to a remote terminal for display thereon.

15. The paintball gun of claim 14, wherein the data communication link includes a wired connection.

16. The paintball gun of claim 14, wherein the data communication link includes a wireless connection.

17. The paintball gun of claim 14, wherein the data communication link includes a removable data carrier.

18. The paintball gun of claim 14, wherein the gun has an integral display.

19. The paintball gun of claim 14, wherein the gun has a display which is removably connected to the gun.

20. The paintball gun of claim 14, wherein the remote terminal is selected from the group consisting of: a computer; a hand-held device; a gun component; a gas regulator; a watch; a mobile telephone; goggle; and a component mounted on a gun.

21. A paintball gun in communication with a remote terminal, the paintball gun comprising:

an input;

a pneumatic system coupled to the input for firing one or more paintballs;

a memory storing a first set of program instructions;

a processing unit coupled to the memory and the input, the processing unit executing the first set of program instructions relating to pneumatic circuit firing mechanism operation data in response to information received from the input; and a data communication link coupled to the processing unit, the data communication link for receiving a second set of program instructions relating to pneumatic circuit firing mechanism operation data, the second set of program instructions replacing the first program instructions, the second set of program instructions controlling the operation of the pneumatic system.

22. The paintball gun of claim 21, wherein the data communication link is configured for wired communication.

23. The paintball gun of claim 21, wherein the data communication link is configured for wireless communication.

24. The paintball gun of claim 21, wherein the first set of program instructions and second set of program instructions are further configured to control rate of fire of the pneumatic system.

25. The paintball gun of claim 21, wherein the first set of program instructions and second set of program instructions are further configured to control valve dwell time of the pneumatic system.

26. The paintball gun of claim 21, wherein the first set of program instructions and the second set of program instructions are configured to control firing mode of the pneumatic system.

27. The paintball gun of claim 21, wherein the data communication link receives information from the remote terminal for display on a portion of the paintball gun.

28. The paintball gun of claim 27, wherein the information is displayed on an LCD located on a grip of the paintball gun.

29. The paintball gun of claim 21, wherein the data communication link receives software upgrades for the paintball gun.

30. The paintball gun of claim 21, further comprising a plurality of control buttons mounted in a normally inaccessible position on the paintball gun.

31. A paintball gun in communication with a remote terminal, the paintball gun comprising:

an input;

a pneumatic system coupled to the input for firing one or more paintballs;

a processing unit coupled to the input, the processing unit controlling operation of the pneumatic system in response to information received from the input, the processing unit generating pneumatic system operation data gathered during operation of the gun; and a data communication link coupled to the processing unit, the data communication link electronically transmitting the pneumatic system operation data to the remote terminal in real time.

32. A paintball gun in communication with a remote terminal, the paintball gun comprising:

an input;

a pneumatic system coupled to the input for firing one or more paintballs;

a memory storing a first set of program instructions relating to the control of valve dwell time of the pneumatic system;

a processing unit coupled to the memory and the input, the processing unit executing the first set of program instructions; and a data communication link coupled to the processing unit, the data communication link for receiving a second set of program instructions relating to the control of valve dwell time of the pneumatic system, the second set of program instructions replacing the first program instructions and controlling the valve dwell time of the pneumatic system.

33. The paintball gun of claim 32, wherein the data communication link receives information from the remote terminal for display on a portion of the paintball gun.

34. The paintball gun of claim 33, wherein the information is displayed on an LCD located on a grip of the paintball gun.

35. The paintball gun of claim 32, wherein the data communication link receives software upgrades for the paintball gun.

36. The paintball gun of claim 32, wherein the data communication link comprises a data carrier.

37. The paintball gun of claim 36, wherein the data carrier is selected from a group consisting of a smart card, a SIM card, a memory card and a computer disk.

38. The paintball gun of claim 32, further comprising a plurality of control buttons mounted in a normally inaccessible position on the paintball gun.

39. A paintball gun in communication with a remote terminal, the paintball gun comprising:

an input;

a pneumatic system coupled to the input for firing one or more paintballs;

a memory storing a set of program instructions for controlling the valve dwell time of the pneumatic system;

a processing unit coupled to the memory and the input, the processing unit executing the set of program instructions relating to controlling the valve dwell time of the pneumatic system.

40. A method of using a remote terminal to communicate instructions to a paintball gun, comprising the steps of:

providing a processing unit for executing a first set of program instructions received from a memory unit, the first set of program instructions relating to the control of operational characteristics of the paintball gun including a pneumatic system;

using a data communication link to send a second set of program instructions relating to the control of operational characteristics of the paintball gun from a remote terminal to the processing unit;

replacing the first set of program instructions with the second set of programming instructions;

using the second set of program instructions to control the pneumatic system of the paintball gun, the pneumatic system configured to control the firing operation of the paintball gun upon receiving information from an input.

41. The method of claim 40, wherein the first set of program instructions and the second set of program instructions include information concerning the control of the valve dwell time of the pneumatic system.

42. The method of claim 40, wherein the data communication link comprises a wired connection.

43. The method of claim 42, wherein the wired connection comprises an RS 232 connection.

44. The method of claim 42, wherein the wired connection comprises a USB connection.

45. The method of claim 42, wherein the wired connection comprises an IEEE 1394 connection.

46. The method of claim 40, wherein the data communication link comprises a wireless connection.

47. The method of claim 46, wherein the wireless connection comprises the use of infrared signals.

48. The method of claim 46, wherein the wireless connection comprises the use of radio signals.

49. The method of claim 40, wherein the data carrier comprises a smart card.

50. The method of claim 40, wherein the data carrier comprises a SIM card.

51. The method of claim 40, wherein the data carrier comprises a memory card.

52. The method of claim 40, wherein the data carrier comprises a computer disk.

53. The method of claim 40, wherein the data communication link comprises a data carrier.

54. The method of claim 40, wherein the data carrier operatively connects with a data reading device on the paintball gun.

* * * * *

UNITED STATES PATENT AND TRADEMARK OFFICE

CERTIFICATE OF CORRECTION

PATENT NO. : 6,615,814 B1 
DATED : September 9, 2003
INVENTOR(S) : John Ronald Rice and Nicholas John Marks It is certified that error appears in the above-identified patent and that said Letters Patent is hereby corrected as shown below:

Title page,
Item [57], ABSTRACT,
Line 2, "and/of" is changed to -- and/or --.

Column 6,
Line 35, "remote." is changed to -- remote terminal. --.
Line 37, "wired" is changed to -- wireless --.

Signed and Sealed this

Thirteenth Day of April, 2004

JON W. DUDAS
*Acting Director of the United States Patent and Trademark Office*